US005165846A

United States Patent [19]

Possell

[11] Patent Number: 5,165,846

[45] Date of Patent: Nov. 24, 1992

[54] SUBSTANTIALLY NOISELESS FAN FOR COOLING MOTORS

[76] Inventor: Clarence R. Possell, 11618 Placid Ct., Colton, Calif. 92324

[21] Appl. No.: 763,262

[22] Filed: Sep. 20, 1991

[51] Int. Cl.[5] ..... F01D 1/36; F03B 5/00

[52] U.S. Cl. ..... 415/90; 415/206; 415/182.1; 415/208.1

[58] Field of Search ..... 416/223 B; 425/90, 203, 425/206, 182.1, 183, 208.1; 417/368

[56] References Cited

U.S. PATENT DOCUMENTS

| | | | |
|---|---|---|---|
| 2,554,602 | 5/1951 | Sutton | 415/208.1 |
| 2,601,947 | 7/1952 | Buttner | 415/208.1 |
| 3,864,055 | 2/1975 | Kletschka et al. | 425/90 |
| 4,036,584 | 7/1977 | Glass | 425/90 |
| 4,518,325 | 5/1985 | Kingston | 417/368 |

OTHER PUBLICATIONS

Possell, Possell Bladeless Process Pumps, Jan. 1983.

*Primary Examiner*—Edward K. Look
*Assistant Examiner*—Mark Sgantzos
*Attorney, Agent, or Firm*—John H. Crowe

[57] ABSTRACT

A motor driven fan having a plurality of annular disks carried by a drive shaft of the motor in closely spaced, parallel relationship. At relatively high motor speeds, bodies of air between the disks are sheared from boundary layers of the air adhering to the sides of the disks and expelled radially outward by centrifugal force acting on them. An annular plate carried by the disk assembly has a cylindrical skirt encircling the disk peripheries which deflects air expelled from between the disks toward the motor to cool it.

8 Claims, 1 Drawing Sheet

SUBSTANTIALLY NOISELESS FAN FOR COOLING MOTORS

BACKGROUND OF THE INVENTION

1. Field of the Invention

This invention relates to fans for cooling motors and has particular reference to such a fan of substantially noiseless character.

2. Description of the Prior Art

Electric motors, particularly when operating under relatively heavy loads, are known to generate enough heat to necessitate the use of cooling fans or the like to dissipate this heat. Heretofore, motor cooling fans have generally comprised rotating members carried by the motor drive shafts having a plurality of radially extending fan blades. As the drive shaft of such a motor is rotated, the fan blades cause a lifting or pushing action against the air to blow it over the motor, and at high speeds the fan blades tend to agitate or churn this air, resulting in air turbulence which causes noise and reduces the air moving efficiency of the fan.

SUMMARY OF THE INVENTION

According to the present invention, a substantially noiseless cooling fan is provided which comprises an assembly of thin annular disks with aligned central openings which are spaced closely together and mounted on a circular plate carried by the motor shaft opposite one end of the motor. A second circular plate having a central opening therein aligned with the openings in the disks is carried by the disk assembly and has a cylindrical flange at its outer periphery extending toward the motor outboard of the peripheries of the disks.

As the body of air between each pair of disks and between each plate and the adjacent disk is rotated, when the motor is running, by virtue of boundary layers of the air adhering to the sides of the disks and plates, the major portion of the body tends to shear from the boundary layers and move radially outward due to centrifugal force. The displaced outwardly flowing bodies of air are deflected over the motor surface by the cylindrical flange of said second circular plate. Incoming air is then drawn through the central opening in the second circular plate and directed radially outward into the spaces between the disks and the disks and plates by a semihyperboloidal deflector carried by the motor shaft.

It is therefore a principal object of the present invention to provide a substantially noiseless cooling fan for an electric motor or the like.

Another object of the invention is to provide such a fan of enhanced air-moving efficiency.

Still another object of the invention is to provide such a fan which can be readily mounted on an existing motor.

Yet another object of the invention is to provide such a fan which is of simple, compact construction and inexpensive to manufacture.

BRIEF DESCRIPTION OF THE DRAWING

The manner in which the above and other objects of the invention are accomplished will be readily understood from the following specification considered in conjunction with the accompanying drawing, wherein.

DESCRIPTION OF THE PREFERRED EMBODIMENT

Figure 1:
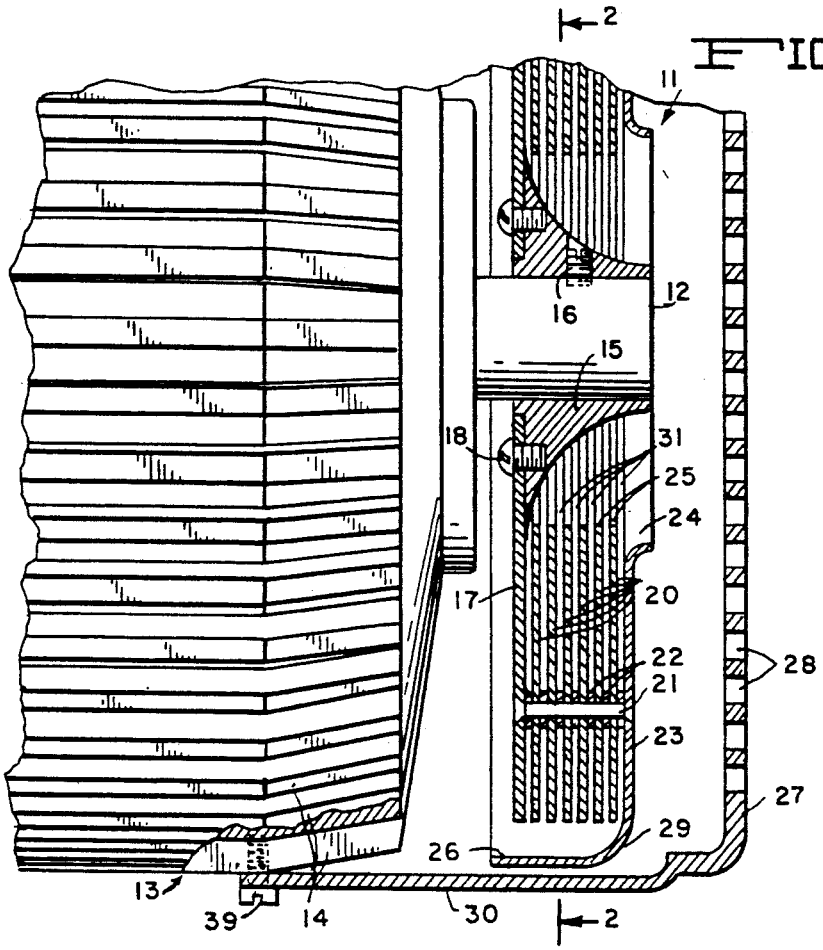
FIG. 1 is a sectional elevational view, partly broken away, through a noiseless cooling fan embodying a preferred form of the present invention and showing it mounted on an electric motor.
Figure 2:
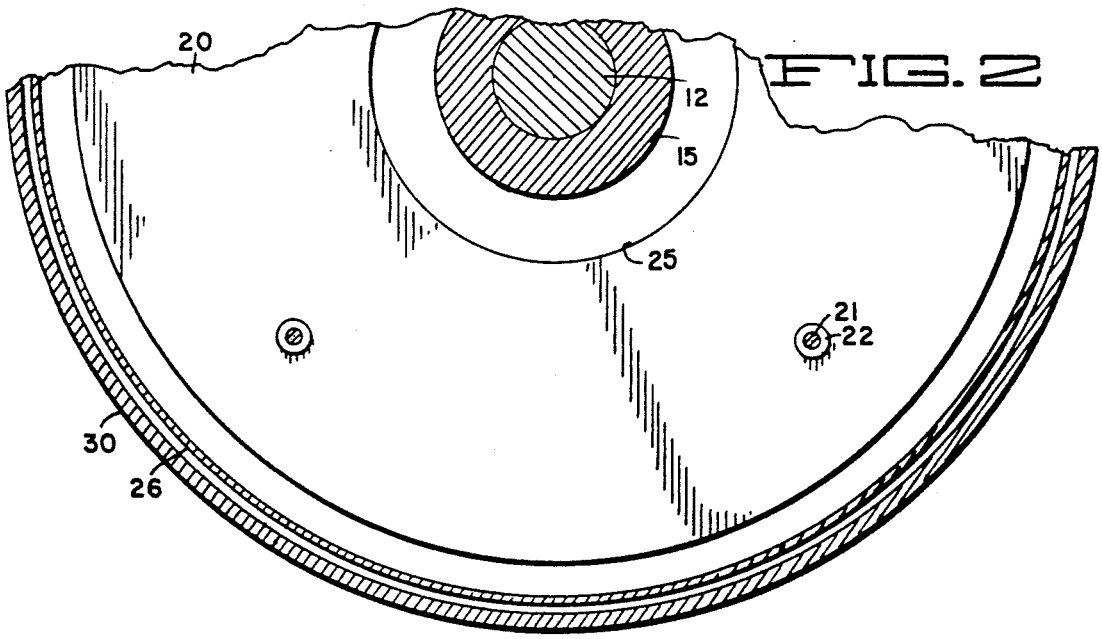
FIG. 2 is a transverse sectional view thereof, partly broken away and taken along 2—2 of FIG. 1.

Referring to the drawing, the cooling fan is shown generally at 11, mounted on the drive shaft 12 of a relatively high speed electric motor partly shown at 13. The latter is of conventional construction, being generally cylindrical in shape and having lengthwise cooling fins 14 disposed therearound.

The fan 11 includes a semihyperboloidal hub 15 attached to the shaft 12 by a set screw 16. A circular disk or plate 17 is secured by screws 18 to the hub 15 and a plurality of thin annular disks 20 with equally sized and aligned central openings 25 are mounted on plate 17 in axial alignment with each other and with the hub 15 by standoff rivets 21. Thin annular spacers 22 are mounted on the rivets 21 to space the disks 20 apart from each other and from plate 17. Typically, the disks 20 are about 0.03-inch thick and the spacing between them is about 0.062-inch.

A thin annular disk or plate 23 having a central opening 24 therethrough aligned with the central openings 25 in the disks 20 is also mounted on the standoff rivets 21 and is spaced from the adjacent disk 20 by respective ones of the spacers 22. The plate 23 has a cylindrical flange 26 formed integral therewith through a curved shoulder section 29. The flange 26 extends around and outboard of the peripheries of the disks 20 and plate 17.

A perforate cover 27 having air passages 28 therethrough is formed with a cylindrical skirt or flange 30 which encircles and extends beyond the flange 26 of plate 23 toward the motor and is fitted around part of the motor housing 13 and suitably secured thereto by screws 39.

When the motor is in operation, individual bodies of air in spaces 31 between the disks 20 and between the plates 17 and 23 and adjacent disks 20 are rotated due to boundary layers of the air adhering to the smooth sides of the disks 20 and the plates 17 and 23. As the disks continue to rotate air in the air bodies is sheared from such boundary layers by centrifugal force and moves in spiral paths radially outward to discharge from the spaces 31. The discharged air masses now combine and are deflected rearwardly, to the left as seen in FIG. 1, by the flange 26 to flow over the fins 14 on the motor housing and carry heat away therefrom. The flange 30 of cover 27 constricts the air deflected rearwardly by the flange 26 to cause it to flow between the motor fins 14 to provide a maximum cooling effect.

Incoming air is drawn through the perforate cover 27 and the central opening 24 in plate 23, then into the disk openings 25 from whence it is directed radially outward by the hub 15 into the spaces 31 between the disks 20 and between the plates 17 and 23 and the adjacent disks 20 to displace the bodies of air being thrown radially outward from those spaces by the disks 20 and plates 17 and 23.

From the foregoing it will be apparent that a novel, efficient, compact and substantially noiseless fan which is inexpensive to manufacture and can be readily mounted on an existing motor is provided by this invention. The volume of air produced by the fan can be changed by varying the number of disks corresponding to disks 20 therein.

A better understanding of the outstanding feature of my novel fan, its capability of operating in virtually noiseless fashion, will be better understood from a comprehension of the manner in which a conventional bladed fan operates. When such a fan is in operation, much noise is created by air oscillation at the discharge side of the fan as a result of frequencies in the moving air caused by the fan blades passing the discharge opening. This can be likened to the noise created by the propeller of a small aircraft during its takeoff because both fan blades and aircraft propellers have lifting surfaces to move the surrounding air as they rotate. By contrast, my novel fan has no blades with lifting surfaces, the air it moves being accelerated outwardly purely by boundary layer drag on disk surfaces in an orderly and very smooth way so that it never gets set into oscillation. The result is an extremely quiet movement of the air.

All conventional types of devices that move or pump air exhibit lifting surface characteristics resulting in a great deal of operating noise as opposed to my novel fan which moves the air in a primarily laminar flow mode with virtually no accompanying noise. Furthermore, the latter moves the air in a substantially higher discharge flow rate than a conventional lifting surface fan does, as I have determined by actual measurements of comparative flow rates between the two types of fan. I have determined, by such flow rate measurements, that my novel fan design has resulted in a significant increase in discharge velocity while its noise level has gone down up to 100%, or more, on a logarithmic noise basis, by comparison with its conventional counterpart.

My novel fan is effective to move air at any motor speed because its boundary layer drag occurs at all velocities. Consequently, even when its motor is just beginning to turn, the fan starts pumping air. The rate of air output of course increases as the rpm of the fan motor goes up.

The following description of the construction and testing of a 40-hp motor incorporating the noel features of my fan, which I was asked to do by a fan manufacturer, illustrates the outstanding improvement of my novel fan over the conventional bladed fan. In constructing my prototype for this test, I substituted my disk system for a 4-bladed fan in a production model marketed by the aforesaid manufacturer. My novel disk mechanism was mounted in place of and on the same shaft as the fan unit in the production model to yield my prototype, and the motor was turned at the same rpm for comparative runs of the production model with its conventional fan system and my modified version thereof. The bladed production model was tremendously noisy because of the blade lifting surfaces going past its discharge opening many times a second to create a noise level with that frequency. This comparative test procedure resulted in a 100% reduction in decibels of my prototype by comparison with the commercial fan with the four blades. The comparison also showed that with my novel prototype there was a substantial reduction in the amount of power necessary to drive the fan and a substantial increase in the amount of cooling air discharged therefrom, compared to the power consumption and discharge air flow from the production model of the fan. This improved performance on the part of my prototype resulted in a very significant reduction in the heating of the operating fan motor.

As those skilled in the art will appreciate, excessive heat is the enemy of an electric motor or generator and the cooling effect of my air moving disks on their driving motor constitutes an important improvement of my novel fan over a conventional fan system with its fan blade lifting surfaces. The lower the generated heat in a fan motor, the less damage to insulation, etc., results when the fan is in operation. This diminished heat generating feature of my novel fan serves to increase its motor cooling effectiveness for purposes of the present invention.

The 40-hp motor employed for the above-described test was a fairly large, heavy motor and one of the noisiest motors that the aforesaid manufacturer produced, which was why it was picked for the test comparison just described.

I claim:

1. A substantially noiseless fan for cooling a motor having a housing and a rotatable drive shaft, said fan comprising:

a disk adapted to be carried by said drive shaft;

a radially extending plate having a central opening forming an air intake for said fan;, supporting means for supporting said plate in spaced parallel and rotatable relationship with said disk;

the spacing between said disk and said plate being such that when the disk and plate are rotated at a suitable speed air therebetween is rotated due at least partially to boundary layers of said air adhering to the facing sides of said disk and said plate, and a portion of the air is sheared from said boundary layers and moved radially outward past the disk periphery due to centrifugal force imposed thereon by the rotating parts;

said plate having a cylindrical flange part encircling the periphery of said disk whereby to deflect said air passing outwardly from between said disk and said plate in an axial direction toward and around the motor housing.

2. A substantially noiseless fan as defined in claim 1 including:

a semihyperboloidal deflector adapted to be carried by said shaft and extending through said central opening for deflecting air from said opening radially outward between said disk and said plate.

3. A substantially noiseless fan for cooling a motor having a housing and a rotatable drive shaft, said fan comprising:

a first disk adapted to be carried by said drive shaft;

a radially extending plate having a central opening forming an air intake for said fan;

a plurality of disks intermediate said first disk and said plate, said disks each having a central opening therein; and means supporting said plate and said plurality of disks in spaced parallel and rotational relationship with said first disk and in spaced parallel relationship with each other;

the spacing between said disks and between said plate and an adjacent one of said disks being such that when said disks and said plate are rotated at a suitable speed by said motor, bodies of air in the spaces between said disks and between said adjacent one of said disks and said plate will be rotated due to the boundary layers of said bodies adhering to the sides of said disks and said plate, and portions of said bodies will be sheared from said boundary layers and moved radially outward due to centrifugal force imposed thereon by the rotating parts;

said plate having an outer cylindrical flange extending around and outboard of the peripheries of said disks whereby to deflect air passing outwardly from between said disks, and from between said plate and said adjacent one of said disks, in an axial direction around the motor housing.

4. A substantially noiseless fan as defined in claim 3 wherein said motor has a plurality of lengthwise cooling fins around the exterior of its housing, and a perforate cover member having a cylindrical skirt adapted to fit around an end of the motor housing to conduct air deflected by said cylindrical flange between said fins.

5. A substantially noiseless fan as defined in claim 4 wherein said perforate member extends across said air intake in said radially extending plate and has openings adapted to permit air to pass therethrough toward the air intake of said plate.

6. A substantially noiseless fan as defined in claim 5 in which the central openings in the plurality of disks are all of round shape and substantially equal size.

7. A substantially noiseless fan as defined in claim 6 in which the central opening in said radially extending plate is of round shape and coaxial with the central openings in said plurality of disks.

8. A substantially noiseless fan as defined in claim 7 in which the central opening in said radially extending plate is larger in diameter than any of the central openings in said plurality of disks.

* * * * *